United States Patent [19]

Coulter

[11] Patent Number: 4,572,484

[45] Date of Patent: Feb. 25, 1986

[54] PALLET CONSTRUCTION FOR TRAVELING GRATE MACHINES

[75] Inventor: Stanley M. Coulter, Wexford, Pa.

[73] Assignee: Dravo Corporation, Pittsburgh, Pa.

[21] Appl. No.: 755,187

[22] Filed: Jul. 15, 1985

[51] Int. Cl.[4] ..... F27B 9/26

[52] U.S. Cl. ..... 266/179; 266/180; 432/137

[58] Field of Search ..... 266/159, 178, 179, 180; 432/137

[56] References Cited

U.S. PATENT DOCUMENTS

| | | | |
|---|---|---|---|
| 3,302,936 | 2/1967 | Ban | 266/145 |
| 3,614,076 | 10/1971 | Schmidt et al. | 266/180 |
| 3,942,658 | 3/1976 | Bonnaure et al. | 266/180 |
| 4,408,987 | 10/1983 | Oyler | 266/179 |

*Primary Examiner*—Melvyn J. Andrews

*Attorney, Agent, or Firm*—Parmelee, Miller, Welsh & Kratz

[57] ABSTRACT

A pallet construction for use in a circular traveling grate machine of the type having rotatable inner and outer side frames which move with the pallets on either side thereof. Various restraining and float means associated with the pallet hanger brackets and their respective axles, as well as with one of the pallet wheels and its respective axle, restrain and permit relative movement of the pallet axles in given radial and circumferential directions, whereby forces and moments are transmitted by the pallets as they mechanically couple the inner and outer side frames. The aforesaid restraining and float means also accommodate the differentials in thermal expansion and contraction between the pallets and the cooler side frames of the traveling grate. The first axles and hanger brackets include spherical antifriction means which permits the pallets to rotatably tilt during the burden discharge operation in situations where the first axles are axially misaligned due to thermal sagging. Further included are spring-loaded sealing pads which accommodate for thermal expansion and seal off the lateral gaps between adjacent pallets so as to reduce the leakage of gas from the pallet wheel tunnels therebetween. A compact lubrication system is also provided for sequentially lubricating and flushing the hanger bracket antifriction means and the pallet wheel bearings.

12 Claims, 10 Drawing Figures

PALLET CONSTRUCTION FOR TRAVELING GRATE MACHINES

CROSS-REFERENCE TO RELATED APPLICATION

This application is related to my commonly owned application entitled: "Circular Traveling Grate Machine", Ser. No. 755,167 and filed concurrently herewith.

BACKGROUND OF THE INVENTION

The present invention relates to gas permeable pallets for supporting a burden in traveling grate machines. More particularly, my invention relates to a pallet construction which is suitable for use in circular traveling grate machines in which one or both of the rotating side frames drive the pallets and wherein thermal expansion and contraction imposes complex dimensional variations within the structure.

Traveling grate machines are relative large and usually designed to handle high tonnage rates of particulate materials in a variety of thermal processes. Such machines may find use in the coking or gasification of coal; heat hardening or prereduction of iron ore pellets; and the retorting of oil shale, to mention a few. The traveling grate machines are characterized by a plurality of pallets, having gas permeable grates, which are moveable along a trackway while supporting a burden through the various process zones of the machine. At the outset, the pallet grates are charged with crushed, balled, pelletized, or otherwise formed and sized particulate material, such as oil shale, coal, iron ore or the like. The pallets and the supported burden are at a relatively cool temperature while in this charging zone. The charged burden is moved slowly by the pallets along the trackway to the high temperature process zones wherein hot gases are passed through the burden and the pallets in an updraft or downdraft mode or an alternating combination of the two. Upon completion of the thermal processing steps, the sensible heat remaining in the burden is oftentimes recovered by passing a cool, quenching gas through the burden and the pallet grates, which yields a cooled spent burden along with a progressing train of pallets which have also been cooled by the quenching gas. The processed, or otherwise spent, burden is then dumped from the pallets and a fresh burden is charged to begin the process cycle once again. Thus, it can be appreciated that the pallets are subjected to a wide variety of temperature and thermal gradients throughout the various zones of the traveling grate machine which necessarily causes similar dimensional variations in the pallets due to the resultant thermal expansion and contraction. These dimensional variations in the pallets are made more difficult to accommodate since the pallets are attached at their lateral edge portions to the relatively cooler, rotating side frames of the traveling grate machine. These side frames are thermally insulated from the process zone and, therefore, do not expand and contract to the same degree as the pallets and, thus, considerable dimensional variations must be dealt with. If these thermal expansion and contraction characteristics are not properly accommodated, the pallets mechanically bind, causing undue wear and/or structural failure with resultant machine stoppage. At the same time, the dimensional tolerances or spacing gaps between adjacent pallets cannot be unreasonably high so as to cause excess tunnel gas leakage between the vertical sides of the moving pallets. Such a condition results in additional gas flow through the pallet wheel tunnels which necessarily increases the size and cost of the air handling system. Thus, it is desirable to maintain a static seal along the lateral gaps between the trailing and the leading ends of the adjacent pallets while still avoiding any likelihood of binding therebetween.

It is further advantageous to employ a pallet which, when attached to the rotating side frames, is able to transmit forces and moments from one side frame to the other. This is, of course, necessary when only one of the side frames is being driven, in which case, the pallets must transmit a driving force and moment to the non-driven side frame. However, even in those cases where both of the side frames are motorized, there are periodic, momentary load mismatches between the moving side frames, since perfect load matching is difficult to achieve in these large structures. When such load mismatching across the side frames occurs. The attached pallets must be capable of transmitting and coupling the resultant forces and moments imposed thereon without undue wear or failure.

It is also a recongized condition in traveling grate machines that over a period of time, the pallets may begin to exhibit a transverse sag, possibly due to prolonged exposure to loading at high temperatures and the related thermal cycling inherent in the process. As a result, binding problems may occur in the pallet axle shafts and conventional shaft bearings of the hanger attachments when the pallets tiltably pivot in the discharge zone of the machine. Costly maintenance and expensive pallet replacement, with attendant machine downtime, can result from this thermal sagging problem.

My present invention solves many of the problems heretofore encountered in circular traveling grate machines of this type, by providing a pallet construction that accommodates the differential expansion and contraction characteristics of the pallets and the side frames of the circular traveling grate machine caused by the cyclical thermal environment imposed on the structure.

The invention further provides a pallet construction which structurally interconnects the rotating inner and outer side frames and transmits forces and moments between the rotating side frames of the traveling grate machine without binding and undue wear. The invention provides a pallet construction having selectively restrained and floating connection means which structurally interconnects the rotating inner and outer side frames of the traveling grate machine to couple forces and moments therebetween. In installations where only one of the side frames is equipped with driving means, the pallets will transmit the driving forces to the other side frame. In those cases where both of the side frames are being driven independently, a coupling action of the pallets accommodates any load mismatching which may periodically occur between the side frames.

My invention still further provides a pallet construction having hanger bracket bushings or bearings which accommodate thermal sag in the pallets, whereby service life of the pallets and hanger brackets is markedly increased.

The pallet construction of the present invention also contains sealing means which provides vertical side seals between the leading and trailing ends of adjacent pallets which results in minimum tunnel gas leakage therebetween.

In addition, my invention provides a pallet construction that includes a lubrication system which permits the lubrication and flushing of the hanger bracket axle bushings or bearings and the rear wheel bearings on opposed sides of the pallet by way of a lubrication port on each side of the pallet at an accessible location, spaced from the heat of the process zone of the machine.

SUMMARY OF THE INVENTION

Briefly stated, the present invention is directed to a pallet construction for use in a circular traveling grate machine of the type which includes rotatable, ring-shaped, inner and outer side frames which define an annular hearth region for the pallets therebetween. The pallets are moveable with the side frames for travel along a circular trackway which lies within the inner and outer trackways of the side frames. The individual pallets comprise a frame having a leading end and a trailing end and opposed, inner and outer lateral edge portions joining said ends. A plurality of spaced-apart, conventional grate elements are positioned on the frame and form a gas permeable surface for supporting a particulate burden thereon.

The leading end of each pallet carries a pair of spaced-apart, spring-loaded, sealing pads, each of which extend outwardly from the leading end, vertically from the top surface to bottom surface to compressively engage the trailing end of a forwardly adjacent pallet in order to seal off the lateral gaps between the pallets and the pallet wheel tunnels. The sealing pads minimize the potential for tunnel gas leakage laterally between adjacent pallets so as to minimize the size and expense of the gas handling system.

The pallet construction of my invention further includes a first pair of fixed axles outwardly extending on opposed lateral edges of the pallet frame, adjacent to the leading end and also a second pair of axles, affixed adjacent to the trailing end of the pallet frame. A pair of hanger brackets each having a bushing end and a latching end are pivotally attached at their respectively bushing ends to the first pair of pallet axles and detachably secured at the latching ends, respectively, to the inner and outer side frames of the machine. A pair of pallet wheels are rotatably mounted on the second, fixed pair of axles to support the pallet and its burden for travel along the pallet trackway. The inner hanger bracket and adjacent axle includes restraining means for inhibiting movement of the pallet axle relative to the hanger bracket in both a radial and circumferential direction. Restraining means associated with the outer hanger bracket and axle permit relative movement of the pallet axle only in a radial direction. The inner pallet wheel has restraining means coacting between the fixed wheel hub and the inner side frame of the traveling grate machine which restrains radial movement while permitting circumferential movement. The outer pallet wheel is unrestrained and, hence, is free to move both radially and circumferentially, relative to a plan view of the circular traveling grate machine. The aforementioned restraining means permit the pallets to transmit forces and moments from one side frame to the other by mechanically coupling together the inner and outer side frames without binding or causing undue wear of the bearings and bushings. The several selected degrees of freedom provided by the restraining means also permits thermal expansion and contraction of the individual pallets, independent of one another, and also independent of the side frames of the machine.

The hanger brackets of the invention include spherical bushings and mating sperical seats which permit the pallets to tilt downwardly in order to dump the processed burden in the discharge zone at the machine, and also permit the first pair of pallet axles to rotate to accommodate for transverse sagging in the pallet frame. The restraining means carried by the hub of the inner pallet wheel also includes a pair of convex-shaped guide surfaces which also compensate for any transverse pallet sag which may be present.

Further, in accordance with my invention, the pallet wheel bearings and hanger bracket bushings are lubricated and flushed of contaminants periodically by way of a compact lubrication system. Each hanger bracket has a bore formed therein with a communicating lubrication fitting situated at the latching end thereof. When latchably attached to the side frames of the machine, the lubrication fittings are accessible to maintenance personnel who periodically attach a pressurized supply of lubrication to the fitting on the hanger bracket. Lubrication flows through the bore within the hanger bracket to the spherical bushings of the first pallet axles and, thence, the lubrication flows through a conduit in fluid communication with the hanger bracket bore along a lateral edge of the pallet to the rear wheel bearings. In this manner, prolonged bearing and bushing life is achieved, with relative ease in maintenance procedures.

BRIEF DESCRIPTION OF THE DRAWINGS

The invention will be more fully understood by reference to the accompanying drawings, in which.

DETAILED DESCRIPTION OF THE INVENTION

Figure 2:
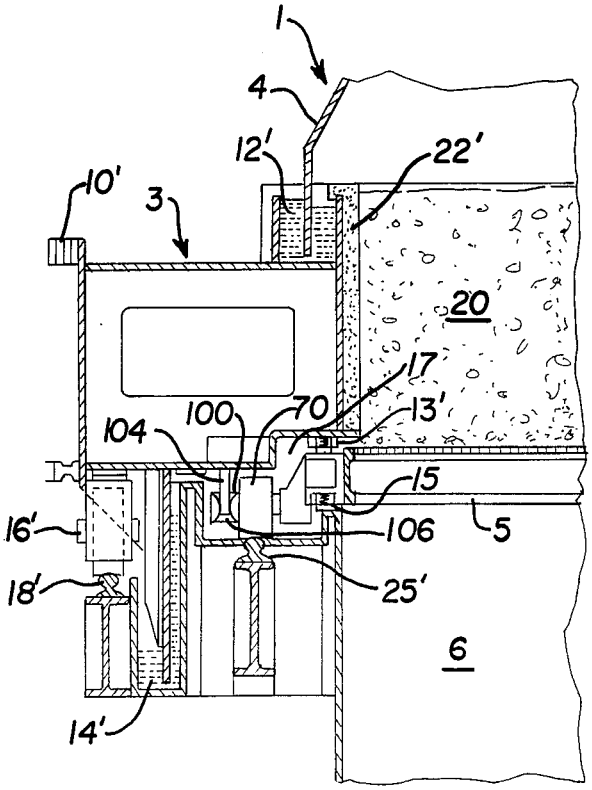
FIG. 2 is a partial radial cross-sectional, cut-away view of a portion of a traveling grate machine incorporating features of the present invention.
Figure 3:
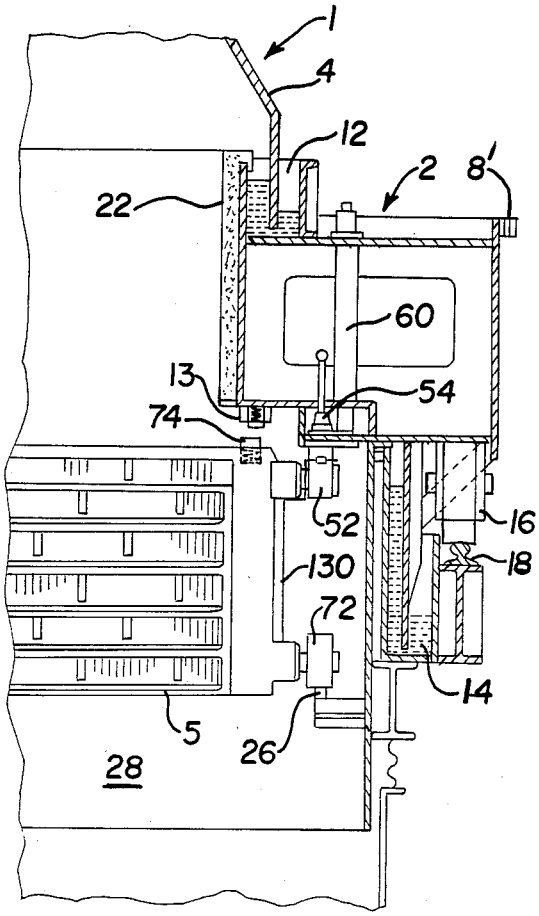
FIG. 3 is a partial, radial cross-sectional, cut-away view taken through the discharge zone of a traveling grate machine, depicting other features of the present invention.
Figure 1:
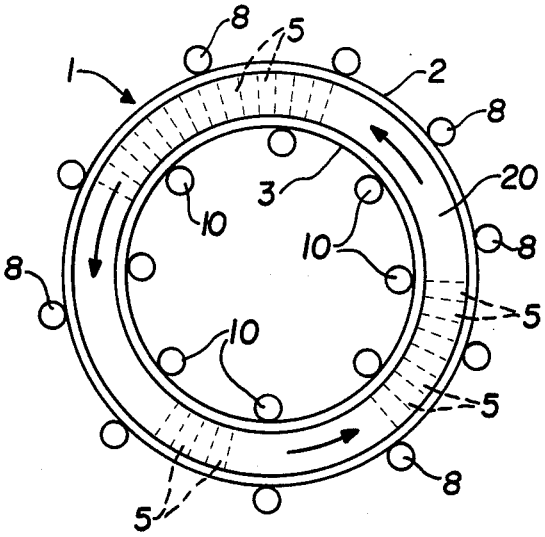
FIG. 1 is a schematic, plan view of a circular traveling grate machine.

Referring now to the drawings and specifically FIGS. 1 through 3, the pallet construction of my invention is specifically suited for use in a circular traveling grate machine of the general type schematically depicted in FIG. 1. The circular traveling grate machine 1 has continuous, outer and inner ring-shaped, side frames 2 and 3, respectively. The outer side frame 2 and the inner side frame 3 are rotatably supported by a plurality of wheeled trucks 16 and 16' respectively which travel on an outer ring-shaped trackway 18 and an inner concentric trackway 18', respectively. Positioned within the annular region defined between the inner and outer side frames is a process region 20 in which are disposed a plurality of movable and tiltable pallets 5 which, as will be explained in greater detail hereinafter, are attached to and travel with side frames 2 and 3. Either one or both of the side frames of the circular traveling grate machine 1 are motivated by a plurality of gear motors 8 which drive the outer side frame 2 by way of gear racks 8' mounted on an outer side wall thereof, FIGS. 1 and 3. In other installations, it may be desirable to drive both of the side frames, in which case a plurality of gear motors 10 are positioned around the inner side frame 3 for driving engagement with the gear rack 10', FIGS. 1 and 2.

The circular traveling grate machine 1, further comprises a stationary roof member 4 which is positioned above the process region 20 and stationary windbox means 6 which is in fluid communication with the roof member 4 within the process zones of the machine. The novel circular traveling grate machine 1 which is more fully described in my co-pending patent application Ser. No. 755,167, filed concurrently herewith, also includes upper liquid sealing troughs 12 and 12' which hermetically seal the outer and inner regions of the hearth adjacent to the roof 4. Machine 1 also includes lower liquid sealing troughs 14 and 14' which hermetically seal the outer and inner regions surrounding the windbox means 6. The continuous side walls of the outer side frame 2 and inner side frame 3 each include a layer of thermal insulation material 22 and 22' affixed thereto in order to insulate the structural members of the respective side frames from the intense heat of the process region 20. As can be seen in Figure 2, the pallet wheels travel in tunnel-like passageways 17 which are filled with an inert process gas to prevent ambient oxygen from leaking into the process region 20. The inert tunnel gas is confined within the passageway 17 by mechanical seals 13' and 15 which engage upper and lower pallet surfaces.

Figure 5:
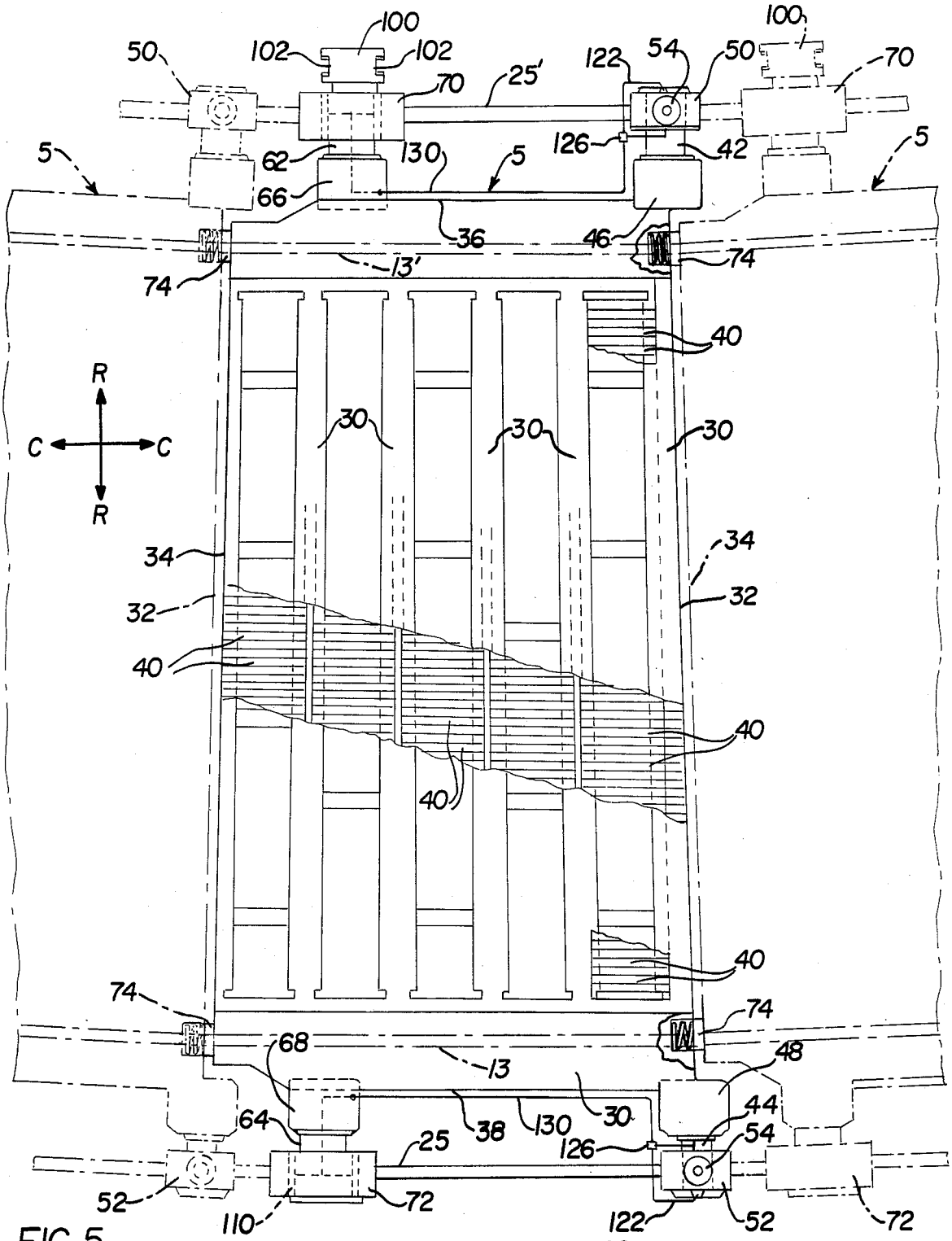
FIG. 5 is a plan view of a pallet of the instant invention with portions cut away.
Figure 6:
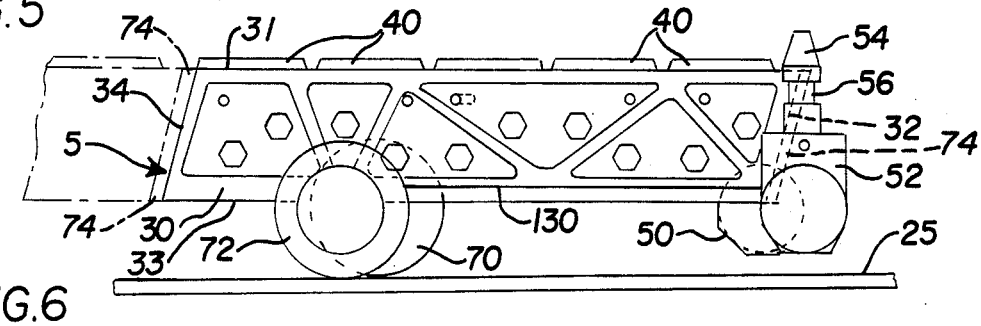
FIG. 6 is a side elevation of the pallet depicted in FIG. 5.

Referring to FIGS. 5 and 6, the pallet 5 of the present invention comprises a frame 30, is preferably constructed of cast steel which tends to resist cracking due to high temperature exposure and thermal cycling. The pallet 5 is generally rectangular and somewhat "pie-shaped" in the plan view of FIG. 5, having its longer dimension in the radial direction indicated by the arrows "RR" in FIG. 5 and its shorter dimension in the circumferential direction as indicated by the arrows "CC". The indicated radial and circumferential directions are with reference to the plan view of the circular traveling grate machine wherein the circumferential direction "CC" is substantially concurrent with the rails 25, 25' of the pallet trackway and the radial direction "RR" is substantially perpendicular thereto. The pallet frame 30 has a leading end 32 and a trailing end 34 and opposed, inner and outer lateral edge portions 36 and 38, respectively, which join the aforementioned leading and trailing ends. A plurality of conventional spaced-apart grate elements 40 are positioned within the spaces provided for on the frame 30 to form a gas permeable grate surface for supporting a particulate burden in conventional fashion.

Figure 4:
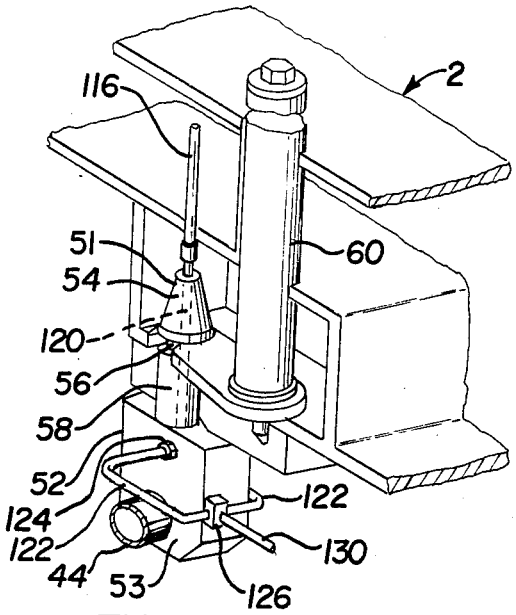
FIG. 4 is a partial, cut-away, perspective view of a hanger bracket and lubrication fitting, forming an aspect of the present invention.
Figure 9:
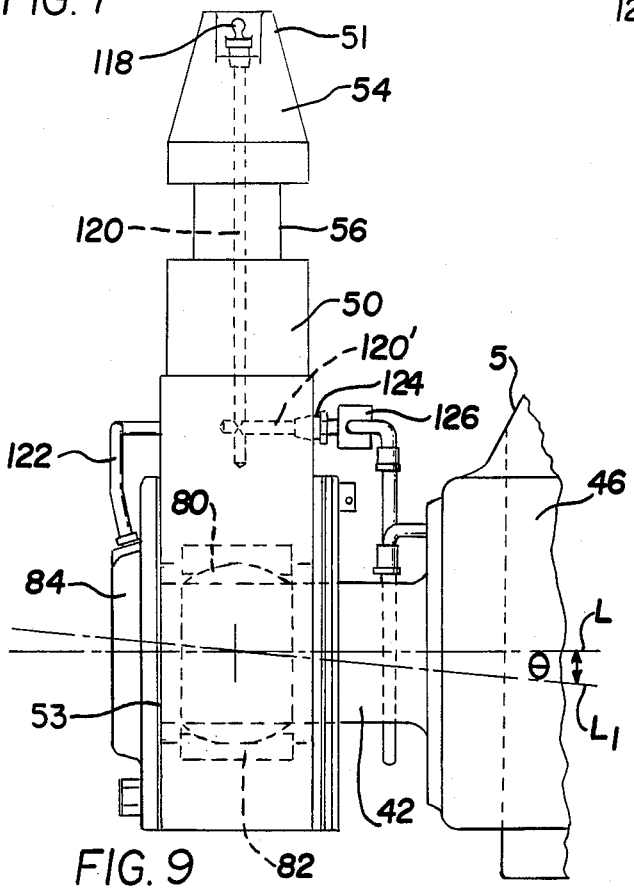
FIG. 9 is a front elevational view of a hanger bracket with portions cut away.

The pallet frame 30 further includes a pair of fixed first axles 42 and 44. The inner, first axle 42 is fixedly secured within an integral pallet hub 46 and, likewise, the outer first axle 44 is fixedly secured within a pallet hub 48 on the outer side of the pallet 5 adjacent the leading end 32 thereof. A pair of inner and outer hanger brackets 50 and 52, respectively, are pivotally attached to the respective axles 42 and 44. As can be seen in FIGS. 4 and 9, each of the hanger brackets 50 and 52 have a latching end portion 51 and a bushing end portion 53. The latching end portion 57 has a cone-shaped end 54, with a neck 56 formed therein. The cone-shaped head portions 54 of the hanger brackets 50, 52 are slid into position within mounting passages 58 of the side frames 2 and 3 and locked into place by way of a rotatable latching arm mechanism 60 which engage the neck portions 56 of the hanger brackets, FIGS. 3 and 4. As explained more fully in my above referenced co-pending application, the latching mechanism 60 permits a quick and efficient removal and replacement of worn or damaged pallets.

The pallets 5 also include a pair of fixed, second axles 62 and 64 outwardly extending on opposed lateral edges of the pallet frame 30. The inner second axle 62 is fixedly secured within an integral pallet hub 66 and the outer second axle 64 is similarly fixedly secured within an integral pallet hub 68. A pair of pallet wheels 70 and 72 are rotatably mounted on the second axles 62, 64, respectively, for travel along the pallet trackway defined by inner rail 25' and outer rail 25.

Hence, in operation, the side frames 2 and 3 are moved along their respective trackways 18, 18' by the gear motors 8 and 10 (if both are employed). The moving side frames, by virtue of their attachment to the hanger brackets 50 and 52, also cause movement of the pallets 5 along the pallet trackway which is defined by the ring-shaped rails 25 and 25'. The pallets lie generally in a horizontal plane throughout the traveling grate machine within the charging and processing zones thereof. When the burden has been fully processed, the generally horizontal trackway 25, 25' contains a downwardly sloping dip rail section 26, FIG. 3, which permits the processed, or otherwise spent, burden to be dumped from the pallets 5 within a discharge zone 28 of the traveling grate machine. In the discharge zone 28, the pallet wheels 70, 72 travel downwardly along the descending rails 26 which causes the pallets to tilt downwardly and pivot about the vertically fixed hanger brackets 50, 52 to permit the burden to fall therefrom by way of gravity. The dip rails 26 then slope upwardly to join the tracks 25, 25' to permit the pallets to assume their normally horizontal mode of travel.

In order to minimize gas leakage laterally between adjacent pallets from the pallet wheel tunnels 17, each of the pallets carry at their leading ends a pair of spring loaded, sealing pads 74 which compressively engage the trailing end 34 of a forwardly adjacent pallet. The sealing pads 74 extend vertically the entire frame height of the pallet, that is, from upper surface 31 to lower surface 33, see FIG. 6. The inert shielding gas is, thus, confined within the pallet wheel tunnels 17 by the mechanical seals 13, 13' and 15 acting on the upper and lower pallet surfaces along the lateral edges 36 and 38 and by the sealing pads 74. An appropriate cavity 76 is formed within the pallet frame 30 adjacent the upper surface of the leading end 32 to receive each of the sealing pads 74 therein. A heat resistant spring element 78 is situated within the cavity 76 and compressively engages the sealing pad 74, biasing the pad outwardly. The springs 78 and sealing pads 74 are held within cavity 76 by alignment pins 75, FIG. 8. In addition to preventing tunnel gas leakage laterally between the pallets, the spring-loaded pads 74 also permit very close and consistant spacing between adjacent pallets, on the order of ⅜ of an inch, so as to accommodate any variations in pallet spacing caused by thermal expansion and contraction.

As will be explained in greater detail, various restraint means are employed in connection with the hanger brackets and pallet wheels and their respective axles in order to accommodate dimensional variations resulting from thermal expansion and contraction and also to accommodate the forces and moments imparted to the pallets by the coupled side frames. The inner hanger bracket 50 is pivotally mounted on the inner first axle 42 which carries a spherical bushing 80 which is fixed both axially and radially relative thereto. Spherical bushing 80 is rotatably received within a mating concave shaped bushing seat 82, which is fixedly secured to the interior of the hanger bracket 50. An appropriate end cover 84 and a ring-seal element 86 are provided to prevent lubrication leakage from the area of the bushing 80, as will be explained in greater detail hereinafter. Due to the fact that the spherical bushing 80 and its mating concave seat 82 are fixed to the axle 42 and the hanger bracket 50, respectively, there is no relative movement of the axle 42 in either the radial or circumferential directions. Thus, the inner hanger bracket 50 completely restrains its axle and only permits the rotation of axle 42 therein for burden discharge purposes.

Figure 8:
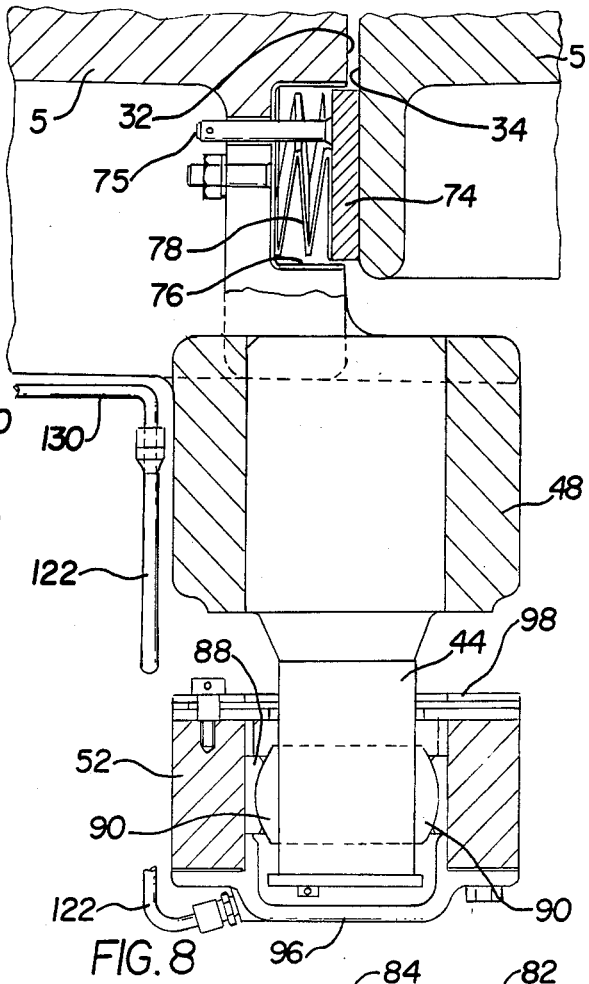
FIG. 8 is a partial, sectional plan view of the outer hanger bracket and one of the spring loaded sealing pads of the pallet of FIG. 5.

The outer hanger bracket 52, on the other hand, permits movement of the axle 44 therein in a radial direction, but restricts movement of that axle in the circumferential direction. Referring to FIG. 8, hanger bracket 52 carries a fixed, concave-shaped bushing seat 88 which rotatably engages a mating spherical bushing 90 slidably mounted on the axle 44. Hence, the outer hanger bracket axle 44 is free to move radially (in the direction of the "R" arrows of FIG. 5) a controlled distance within the hanger bracket 52. An appropriate end cover 96 and sliding seals 98 are attached to the hanger bracket 52 to confine and control the leakage of lubrication therefrom. While the above-described, spherical bushings 80 and 90 are preferably employed in the hanger brackets 50 and 52, respectively, it will, of course, be understood that other spherical antifriction means, such as spherical bearings, can be used in place of the bushings 80 and 90.

Figure 7:
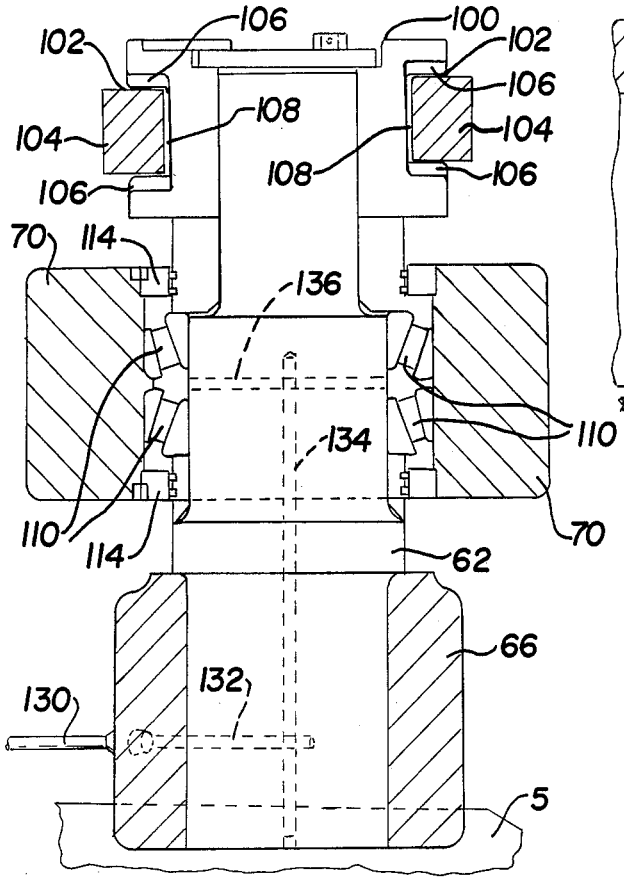
FIG. 7 is a partial, sectional plan view of the inner wheel assembly carried by the pallet of FIG. 5.

Referring now to FIGS. 2, 5 and 7, the inner pallet wheel 70 carries a guide block 100 which is fixedly attached to the axle 62. The guide block 100 contains opposed, slotted areas 102 which are adapted to receive a pair of spaced-apart alignment lugs 104 therein. As can be best seen in FIG. 2, the alignment lugs 104 are rigidly secured to and extend downwardly from a bottom plate of the inner side frame 3 and slidably engage the convex-shaped seating surfaces 106 of the guide block 100 to prevent movement in a radial direction. The slotted areas 102 are machined so as to provide a small clearance gap 108 between the inner faces of the alignment lugs 104 and the guide block 100 which provides for some limited circumferential movement of the wheel 70 and axle 62 relative to the alignment lugs 104. The alignment lugs will disengage the guide block 100 for a short time as the pallets downwardly tilt in the discharge zone 28, as can be appreciated by comparing the relative pallet positions of FIGS. 2 and 3.

The outer pallet wheel 72 and its fixed axle 64 are unrestrained relative to the outer side frame 2 and, therefore, are free to move in the radial and circumferential directions. Thus, the inner hanger bracket 50 restrains radial and circumferential movement of the axle 42 therein while the outer hanger bracket 52 restrains circumferential movement but permits controlled movement of the axle 44 therein in the radial direction. Axle 44 is permitted approximately one inch of controlled movement in the radial direction through the sliding action of the spherical bushing 90 thereon. The rear pallet wheel 70 and axle 62 are restrained radially by the guide block 100 but permitted to move circumstantially by the guide block approximately 1/16 of an inch. These restraining means and controlled float permit the pallets 5 to expand and contract independently of the side frames 2 and 3. As previously stated, the side frames generally remain cooler than the pallets due to the thermal insulation provided by the refractory layers 22, 22' which thermally shield the structural plates from the intense heat which is present in portions of the process region 20. The restraining means also allows the pallets 5 to function as an efficient coupling arm between the rotating side frames 2 and 3 by resolving the several major forces about the fixed connection of hanger bracket 50. The forces are resolved and binding is prevented by the degree(s) of freedom provided by hanger bracket 52 in a radial direction and the degree(s) of freedom provided by guide block 100 in the circumferential direction, taken with the total freedom provided by outer pallet wheel 72.

The pallet frames 30 are constructed of a heat resistant ferrous, material; however, after prolonged exposure to elevated temperatures and thermal cycling within the traveling grate machine, they may tend to exhibit transverse sagging. As seen in FIG. 9, the longitudinal axis "L" of the axle 42 generally lies in a horizontal plane, such as when the pallet 5 is in a new or unsagged condition. After thermal sagging occurs in the pallet, the longitudinal axis of the axle assumes the position "$L_1$" which is offset from the horizontal by some angular value, designated "$\theta$" in FIG. 9. The bushing 80 and its concave seat 82, due to the spherical shape, permit the axle 42 to angularly sag while still allowing the pallet to rotate and tilt downwardly and upwardly as required in the discharge operation depicted FIG. 3. This same, thermally induced sagging phenomenon also detrimentally affects the second pair of rearwardly disposed, fixed axles, 62 and 64. The sagging causes a potential problem, however, only in axle 62 and its inner wheel 70, since the outer wheel 72 is unrestrained and can freely accommodate the sagging. In order to anticipate potential pallet sag and attendant axle deflection on the restrained, inner axle 62, the slotted areas 102 of the guide block 100 are provided with convex-shaped seating surfaces 106. The convex surfaces permit angular deflection between the slots 102 and the respective alignment lugs 104 and prevents binding therebetween which could interfere with the free tilting of the pallets during the discharge operation.

The rear pallet wheels 70 and 72 are mounted on the fixed pair of second axles 62 and 64, respectively, and each rotates upon two sets of tapered roller bearings 110, FIG. 7. Lubrication is retained within the confines of the bearings 110 by a pair of ring-shaped sealing elements 114.

Figure 10:
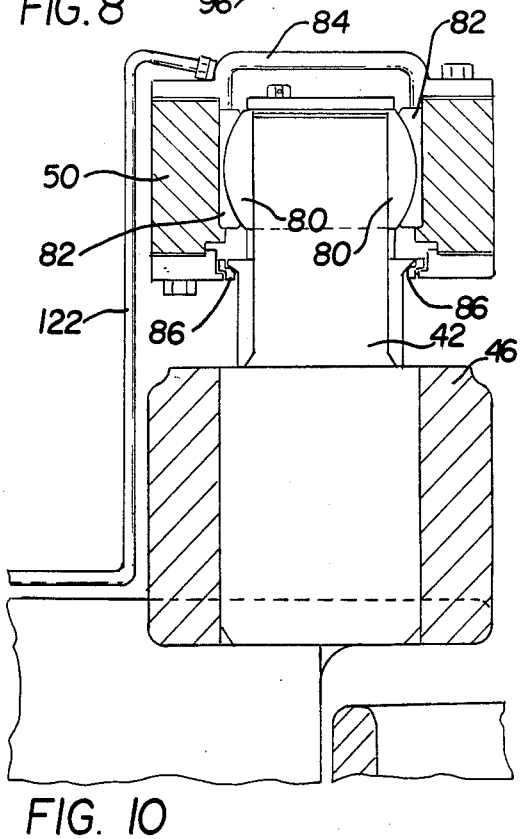
FIG. 10 is a partial, sectional plan view of the inner hanger bracket of the pallet shown in FIG. 5.

In order to prolong the life of the spherical bushings 80 and 90 and their respective bushing seats and the roller bearings 110 of the pallet wheels, it is necessary to periodically supply lubrication directly to those elements in order to lubricate and to flush foreign matter therefrom which naturally accumulates during operation in the somewhat dirty environment of the traveling grate machine. Lubrication under pressure is periodically introduced to the pallets 5 through each of the hanger brackets 50 and 52 by maintenance personnel or by some automatic lubrication means, through a conduit 116, FIG. 4. As also seen in FIG. 9, the hanger brackets have a lubrication fitting 118 attached at the top of the conical head portion 54. Lube fitting 118 is in fluid communication with an internal lubrication bore 120 which is formed through the neck portion of the hanger bracket and extends to the bushing end 53 thereof. The internal bore 120 may extend directly into the area of the spherical bushings 80 and 90 or it may communicate with a horizontally disposed second lubrication bore 120', which, in turn, communicates with an external lubrication line 122 by way of a fitting 124 and a slide valve element 126. Conduit 122 communicates with the interior or the hub portion of the hanger brackets through the end cover 84, FIGS. 9 and 10. A lubrication conduit 130, which may be flexible, communicates with the slide valve element 126 and transmits lubrication from the hanger brackets to the pallet wheel hubs 66 and 68. As shown in FIG. 7, internal bores 132, 134 and 136 are formed within the axles 62 and 64 to permit the supply of lubrication from conduit 130 to the roller bearings 110 within the wheels 70 and 72. Thus, lubrication is supplied via conduit 116 to the hanger bracket bushings and thence to the pallet wheel bearings even through these rotatable components are normally inaccessible within the confines of the machine.

While a specific embodiment of my invention has been described in detail, it will be appreciated by those skilled in the art that various modifications to those details can be made in light of the teachings of the disclosure. Accordingly, the particular arrangement shown and described herein is meant to be illustrative only and not limiting as to the scope of the invention which is to be given the full breadth of the appended claims and any and all equivalents thereof.

Having described my invention, what is claimed is:

1. In a circular traveling grate machine of the type having continuous inner and outer, rotatable side frames in which one or both of the side frames are motor driven and having a plurality of pallets for movement along a pallet trackway positioned beteen the side frames, an improved pallet construction, wherein each pallet comprises:

a pallet frame having a leading end and a trailing end and a pair of spaced-apart lateral edges joining said ends;

a plurality of spaced-apart grate elements positioned on said pallet frame forming a gas permeable surface for supporting a burden thereon;

a pair of fixed, first axles and a pair of fixed, second axles, outwardly extending and spaced-apart on opposed lateral edges of the pallet frame;

a pair of hanger brackets each having a bushing end and a latching end, each of said hanger brackets pivotally connected at the bushing end to a first axle and fixedly attached to one of the inner and outer frames of the machine at the latching end;

a pair of pallet wheels, each rotatably mounted on one of the second axles for travel along the pallet trackway;

first restraining means associated with one of the hanger brackets for preventing relative movement between said one hanger bracket and its attached axle in a radial direction and in a circumferential direction, wherein the pallet trackway is substantially concurrent with and defines said circumferential direction, and said radial direction is substantially perpendicular thereto;

second restraining means associated with the other of said hanger brackets for preventing relative movement between said other hanger bracket and its attached axle in the circumferential direction and for permitting relative movement restrained within a predetermined distance in a radial direction; and third restraining means associated with one of the pallet wheel axles and an adjacent side frame of the machine for preventing relative movement between said one pallet axle and adjacent side frame in a radial direction and for permitting relative movement restrained within a predetermined distance in a circumferential direction, whereby each of said pallets mechanically couple said inner and outer side frames together and transmit forces and moments to accommodate mismatched driving forces on the side frames and to accommodate dimensional variations in the pallets and side frames caused by thermal expansion and contraction.

2. The pallet construction of claim 1 wherein one of the side frames is motor driven and the other side frame is motivated by the forces and moments transmitted by the pallets coupled thereto.

3. The pallet construction of claim 2 wherein the first restraining means is associated with the hanger bracket which is attached to the inner side frame, the second restraining means is associated with the pallet wheel axle adjacent to the inner side frame.

4. The pallet construction of claim 1 wherein the pivotal connection between the bushing end of each of the hanger brackets and the first pair of axles includes spherical antifriction means carried by each of said first pair of axles and mating seating means carried by said hanger brackets, whereby said sperical antifriction means and seating means accommodate lateral deflections in said pallet and first pair of axles due to thermal sagging so as to permit the pallet and first axles to pivotally tilt about said hanger brackets in a discharge zone of the traveling grate machine.

5. The pallet construction of claim 4 wherein the spherical antifriction means comprises spherical bushing means.

6. The pallet construction of claim 1 wherein the third restraining means comprises a guide block fixedly attached to and outwardly extending from one of the pallet wheel axles and having a pair of spaced-apart, vertical alignment channels formed therein, the side frame adjacent said guide block including a pair of spaced-apart alignment lugs downwardly extending therefrom for vertically sliding engagement with the alignment channels of the guide block.

7. The pallet construction of claim 6 wherein the alignment channels of the guide block include opposed pairs of concave-shaped seating surfaces which engage opposed sides of the alignment lugs, whereby lateral deflection of said pallet and pallet wheel axle due to sagging is accommodated by the guide block.

8. The pallet construction of claim 6 wherein the other of said pair of pallet wheel axles and its rotatably mounted wheel are free to move relative to the adjacent side frame in a radial direction and a circumferential direction.

9. The pallet construction of claim 1 wherein one of the ends of the pallets includes spring loaded sealing pad means outwardly and vertically extending from said pallet adjacent opposed lateral sides thereof, said sealing pad means adapted to compressively engage end portions of an adjacent pallet to seal the lateral gaps between said adjacent pellets whereby lateral gas leakage between the adjacent pallets is minimized.

10. The pallet construction of claim 9 wherein the sealing pad means is located on the leading end of the pallet.

11. The pallet construction of claim 1 wherein the pivotal connections between the hanger brackets and the first pair of axles include spherical antifriction means and seating means and said second axles have bearing means mounted for rotation thereon.

12. The pallet construction of claim 11 wherin each of said hanger brackets have a lubrication bore formed therein extending from the latching end toward the bushing end, conduit means communicating with said bore and with the antifriction means and further communicating with the bearing means of a respective pallet wheel and second axle, whereby when an external source of pressurized lubrication is introduced into the lubrication bore of the hanger bracket at its latching end, said lubrication travels to said antifriction and seating means and thence to said pallet wheel bearing means by way of said conduit means.

* * * * *